US006003846A

United States Patent [19]

Adib et al.

[11] Patent Number: 6,003,846

[45] Date of Patent: Dec. 21, 1999

[54] AIR HUMIDIFIER APPARATUS

[76] Inventors: Camille Adib, 61, Fernlea Crescent, Ville Mont-Royal QC, Canada, H3P 1T7; Boonley Fu, 29, Hayward Crescent, Scarborough ON, Canada, M1S 2T7

[21] Appl. No.: 09/038,363

[22] Filed: Mar. 10, 1998

[51] Int. Cl.[6] ..... B01F 3/04

[52] U.S. Cl. ..... 261/43; 261/96; 261/DIG. 46

[58] Field of Search ..... 261/43, 83, 92, 261/DIG. 46

[56] References Cited

U.S. PATENT DOCUMENTS

| | | | |
|---|---|---|---|
| 3,386,711 | 6/1968 | Williams | 261/70 |
| 3,481,588 | 12/1969 | Lobb | 261/2 |
| 3,595,269 | 7/1971 | Yeagle | 261/92 |
| 3,758,086 | 9/1973 | Pugh | 261/92 |
| 3,773,307 | 11/1973 | Karlsson | 261/DIG. 46 |
| 3,867,485 | 2/1975 | Yeagle | 261/7 |
| 4,255,361 | 3/1981 | Goettl | 261/DIG. 46 |
| 4,289,713 | 9/1981 | Goettl | 261/DIG. 46 |
| 4,333,887 | 6/1982 | Goettl | 261/DIG. 46 |
| 4,361,522 | 11/1982 | Goettl | 261/DIG. 46 |
| 4,386,038 | 5/1983 | Walker | 261/DIG. 46 |
| 4,510,766 | 4/1985 | Curtis, Sr. | 261/DIG. 46 |
| 4,576,013 | 3/1986 | Sperr et al. | 261/DIG. 46 |
| 5,292,106 | 3/1994 | West et al. | 261/DIG. 46 |

*Primary Examiner*—C. Scott Bushey
*Attorney, Agent, or Firm*—Holland & Knight LLP

[57] ABSTRACT

An air humidifier apparatus with a time switch system combined to a circulation mechanism allowing for a controlled cyclical flow of water into a drain of the basin containing water in which soaks a spongy and absorbent material located on the circumference of a rotary drum, thus preventing any accumulation of limestone and other minerals in the water of the basin. The circulation mechanism that includes valves allows for a controlled flow of water while preventing any continuous flow of water through the drain in the case the humidifier stops in a position with an opened drain. Furthermore, the water can flow by that same drain if there is an overflow of water in the basin.

11 Claims, 5 Drawing Sheets

AIR HUMIDIFIER APPARATUS

FIELD OF THE INVENTION

This invention relates to the field of humidifiers, particularly to the residential and industrial air humidifiers.

BACKGROUND OF THE INVENTION

The apparatus for air humidification, called humidifier, is used to eliminate the trouble caused by a low level of ambient humidity present in a residential, commercial or industrial environment. The drop of ambient humidity is generally caused by a hot air circulation drying the air, generally during winter, when the air heating period duration is extended, thus causing an important evaporation of water every day.

A big amount of water evaporating from the humidifiers causes an increase in the concentration of various minerals contained in the water, thus causing deposits of those minerals in the water evaporation system of the humidifier and reducing the evaporation efficiency along with the whole humidifier efficiency. In order to avoid this problem frequent cleaning of the evaporation system is required thereby causing a waste of time. Therefore, the usefulness and the efficiency of this humidifier are limited.

Concerning the elimination of problems related to the increase of the minerals concentration, a simple circulation of the water through the humidifier basin is sufficient; nevertheless, no humidifier known to date performs adequately.

In some humidifiers, the amount of water coming from a continuous water flow in order to avoid mineral deposits by means of evaporation is excessive, thus producing an important and useless waste of water.

In some humidifiers, the continuous or intermittent water flow through the evaporation means is activated by components that are likely to malfunction in case of mineral deposition on them, thus making the humidifier operation ineffective after a short period of time.

In other humidifiers, the incoming water flow cannot be stopped during a power breakdown or a voluntary stop of the humidifier activation mechanism, the wasted water is either evacuated by the drain of the evaporation means or simply overflows from the basin.

In some humidifiers, the device used for the water draining can get obstructed by lack of efficient water filtration, thus producing water to overflow from the basin.

In some humidifiers, the basin does not even allow for the water to flow through a drain in case of water surplus in the basin.

The above-mentioned problems associated to the known art related to humidifiers are resolved with the water cyclical circulation mechanism activated by a time switch of the present invention, that prevents any possible accumulation of mineral deposits in the water evaporation means as well as in the different components of the humidifier. The circulation mechanism controlling the flow of water has a safety means against water overflow, and also filters and controls the access of water to the drain.

SUMMARY OF THE INVENTION

The air humidifier apparatus of the present invention comprises:

- a water entry;
- a basin intended to contain the water coming from said entry;

- a level regulator allowing to maintain a constant water level in the basin;
- an evaporator forcing an evaporation of the water from the basin in the air;
- a circulation means allowing a cyclical circulation of the water in the basin;
- an air intake and exit allowing air circulation through the evaporator;
- a time switch means activating the circulation means and setting in motion the cyclical circulation of the water in the basin said time switch means being activated by said evaporator; and
- a drain allowing the water to escape from the basin.

Preferably, the circulation means being a tank linked to the basin by a first hole which opening is controlled by a first valve, and linked to the drain which closing is controlled by a second valve, the first hole and the drain never being simultaneously opened, the first and second valves being activated by the time switch means, the first hole allowing for water to get into the tank that is afterwards emptied when the drain is opened.

Preferably, the time switch means comprises:

- a first cam allowing for operation of the first valve;
- a second cam allowing for operation of the second valve;
- a first holding means forcing the first valve to follow the first cam;
- a second holding means forcing the second valve to follow the second cam;
- an activation mechanism activating the first and second cams.

Preferably, the evaporator comprises:

- a rotary drum having two circular extremities and being covered on its cylindrical peripheral surface with spongy material absorbing water and having a small part of the covered surface submerged into the water;
- a drive mechanism providing a rotating motion to the drum.

Preferably, the activation mechanism comprises a cogwheel linked to the cams through a shaft and activated by a plurality of rods located on one of the extremities of the drum of the evaporator.

Preferably, the second holding means comprises:

- a stop fixed to the second valve activated by the second cam via the activation mechanism;
- a spring applying pressure on the second valve in order to push the stop into the axis direction of the second cam.

Preferably, the first valve being linked to the second valve by a fixed rod, the fixed rod making the first and second cams as well as the first and second holding means being integrally connected as to form one piece.

Preferably, the basin comprises a pipe means to discharge the overflow of water from the drain of the basin of the humidifier.

Preferably, the air humidifier apparatus further comprises an intermediate cavity linked to the basin by a filter allowing for filtration of the water before its entry in the tank by the first hole.

Preferably, the air humidifier apparatus further comprises a stabilization means of the activation mechanism.

Preferably, the cogwheel comprises eight cogs, and the drum having only one the rod.

Preferably, the stabilization means comprises:

- a jagged wheel coaxially mounted on the shaft and having a number of outlines equal to the number of cogs of the cogwheel;

a ratchet allowing for the stabilization of the jagged wheel from any rotating movement of the shaft.

DETAILED DESCRIPTION OF THE PREFERRED EMBODIMENT

Figure 2:
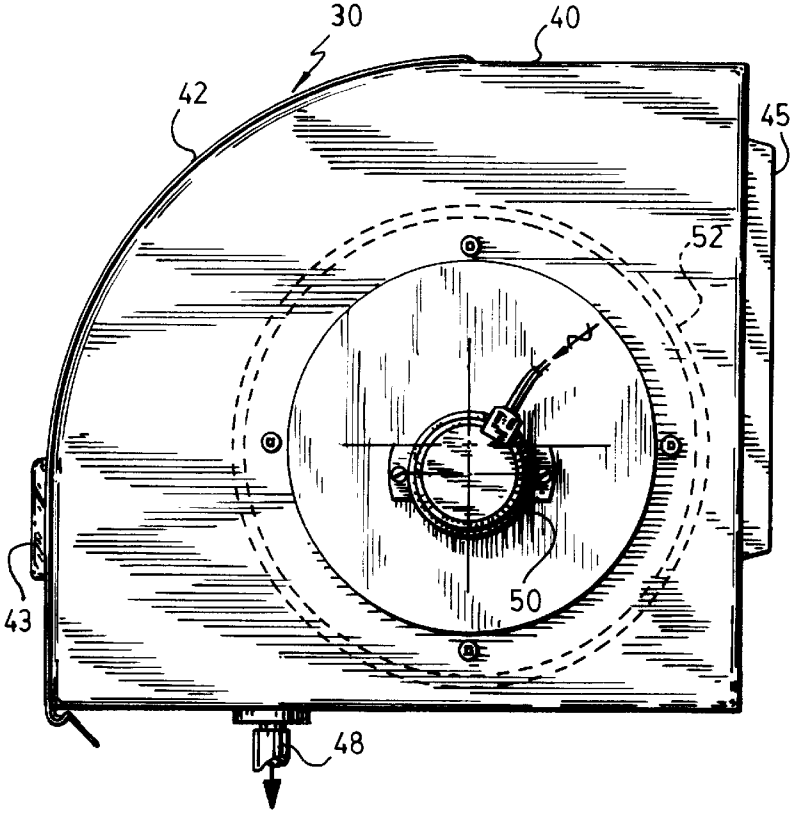
FIG. 2 is side view of the preferred embodiment of FIG. 1.
Figure 1:
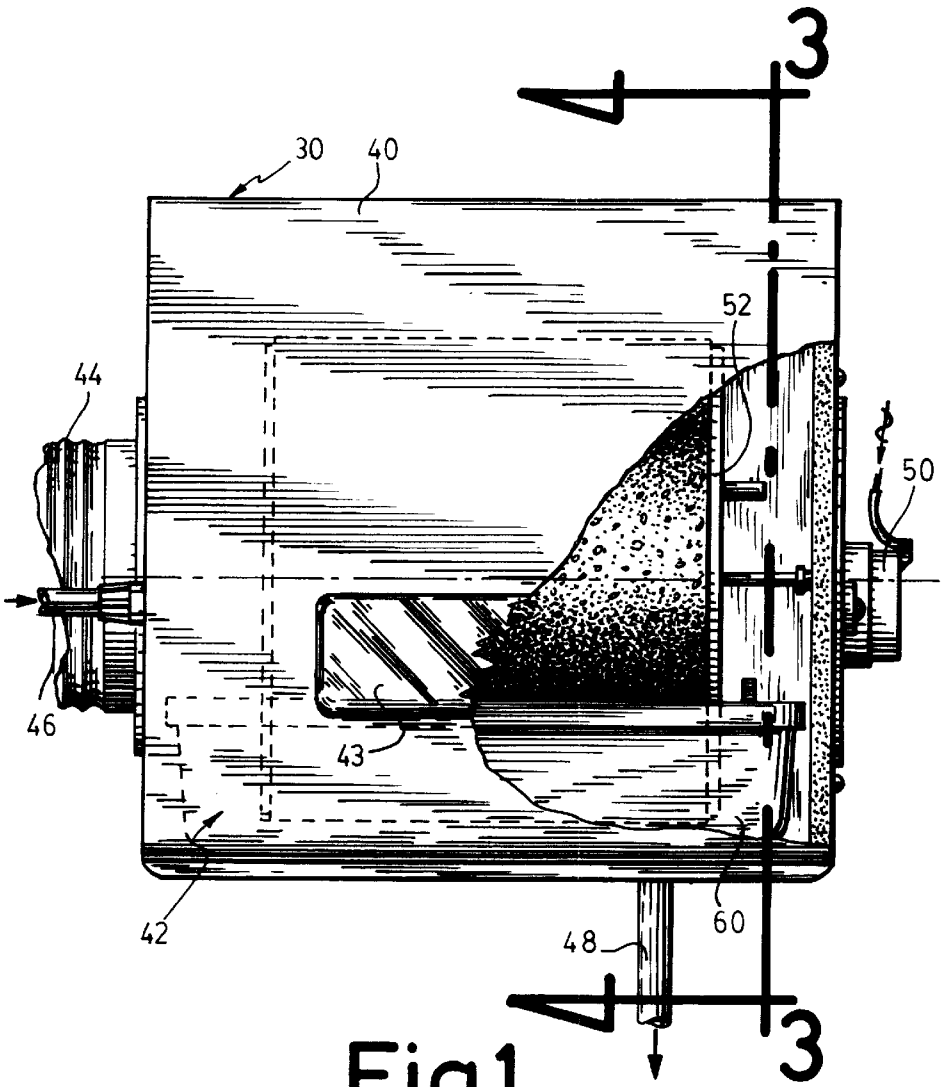
FIG. 1 is a partially broken front elevation view of the preferred embodiment of an air humidifier.
Figure 3:
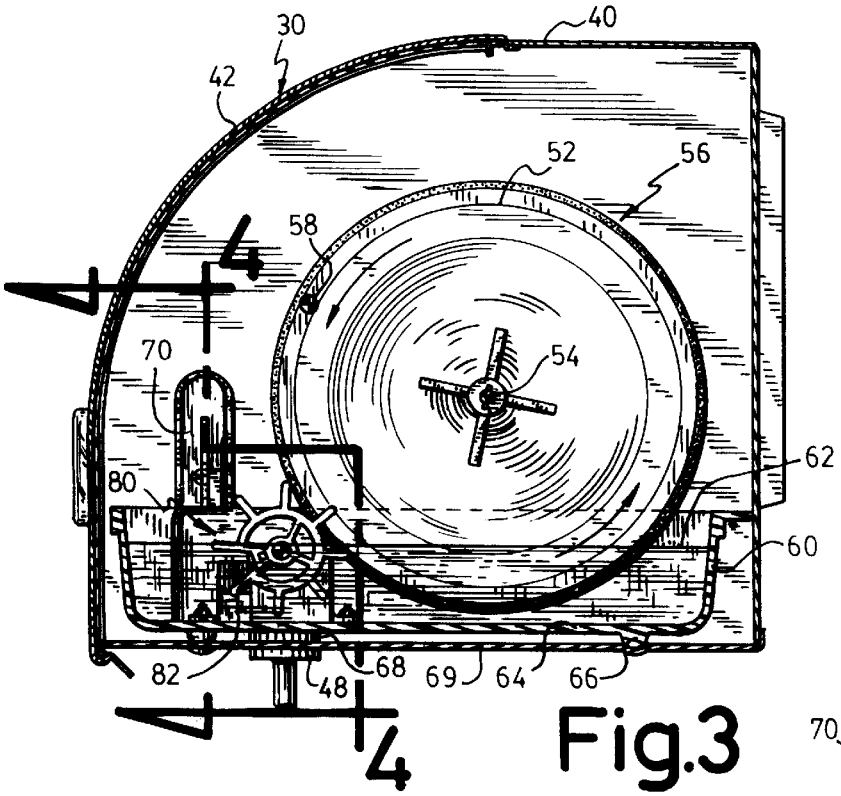
FIG. 3 is a sectional view according to line 3—3 of FIG. 1.

In an air humidifier apparatus, a humidifier 30 connected to a heating system and represented on FIGS. 1 to 3 comprises an external shell 40, having a curved access door 42 with a small window 43 at the top allowing for access to a basin 60 intended to contain water and to an evaporator, preferably a drum 52 covered on its cylindrical peripheral surface by a spongy material absorbing water from the humidifier 30.

According to FIG. 1 representing the front view of the humidifier 30, it is shown an air exit 44 on the left hand side as well as a water inlet 46 and, on the bottom, the drain 48 of the basin 60. The drum 52 of the humidifier 30 is actuated by a drive mechanism, preferably an electrical engine 50 as seen on FIG. 2. An air intake 45 is located at the back of the humidifier 30. The inside of the humidifier consists of a cylindrical drum 52 having a small part of its circumference submerged into the water inside the basin 60 whose bottom 64 rests on the feet 66 of the basin 60, and having a collar 68 integrated to the basin 60, surrounding the drain 48, and resting on the bottom surface 69 of the humidifier 30. A water circulation system attached to the basin 60 is located inside a housing 80 on which is mounted a cogwheel 82 activating the circulation mechanism. Furthermore, a water level regulator, preferably formed of a float 72 activating a flap 70 at the water inlet 46, maintains a constant level of water 62 in the basin 60.

Figure 4:
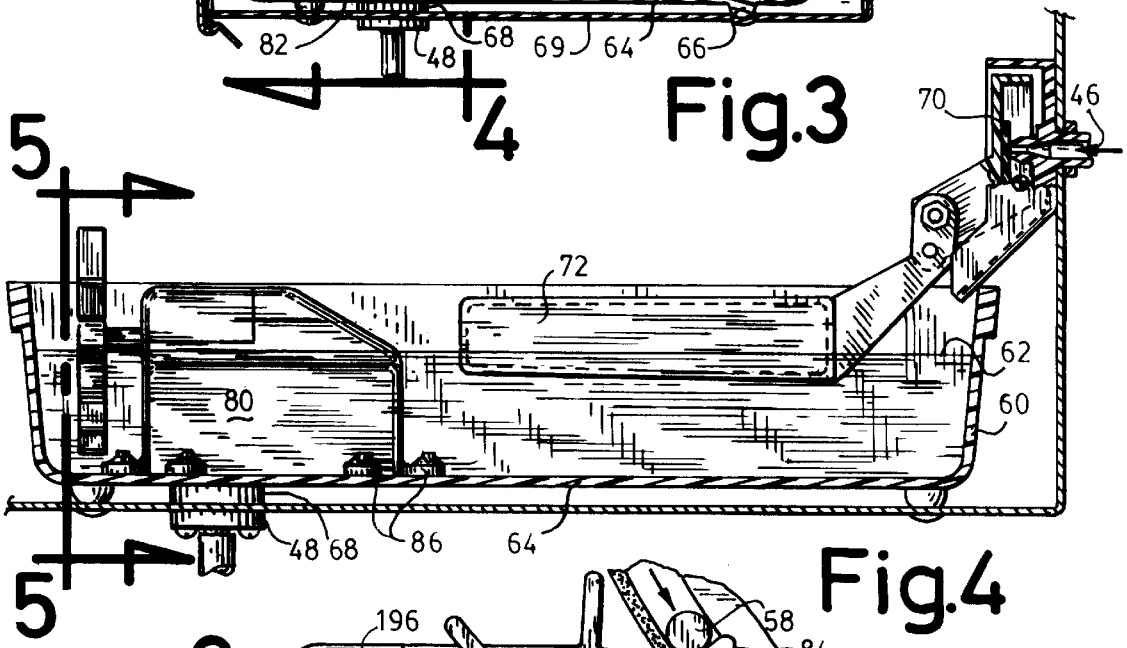
FIG. 4 is a sectional view according to line 4—4 of FIG. 3
Figure 5:
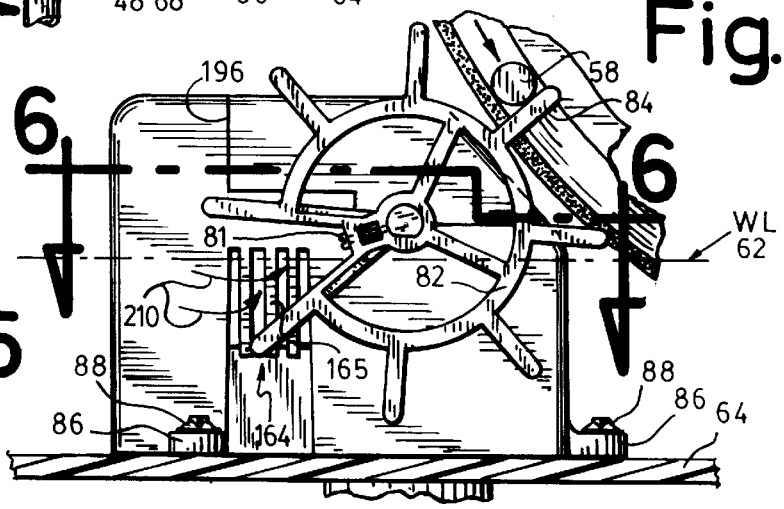
FIG. 5 is a sectional view according to line 5—5 of FIG. 4.
Figure 6:
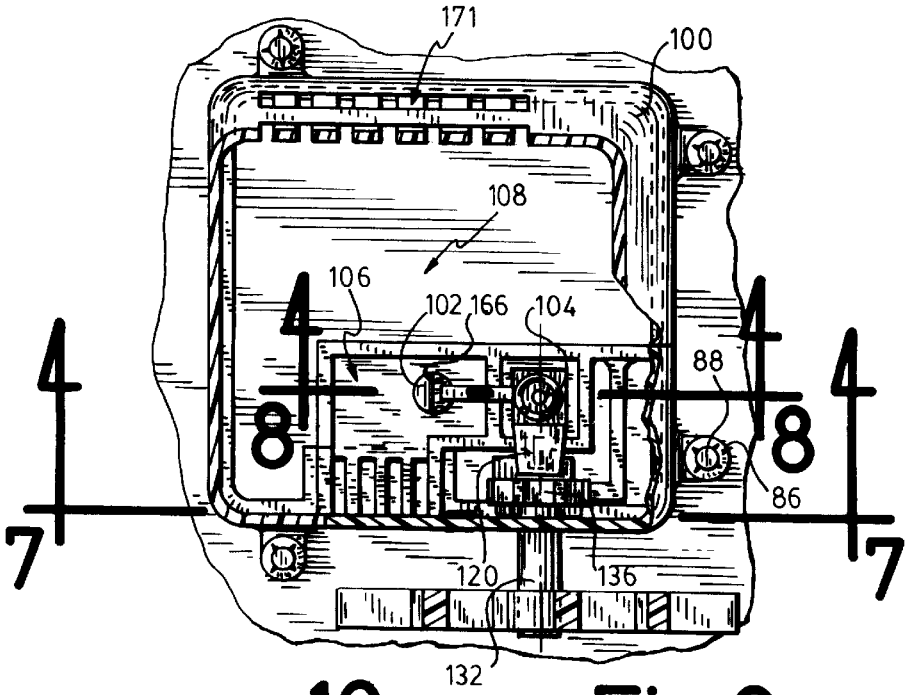
FIG. 6 is a sectional view according to line 6—6 of FIG. 5.
Figure 7:
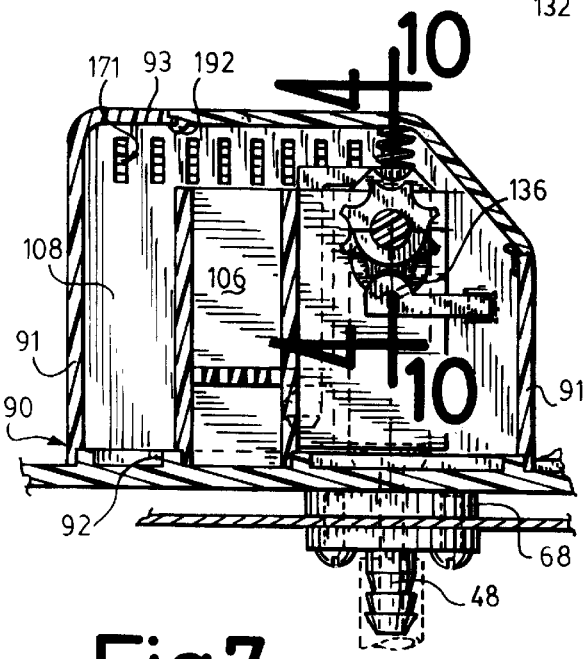
FIG. 7 is a sectional view according to line 7—7 of FIG. 6
Figure 20:
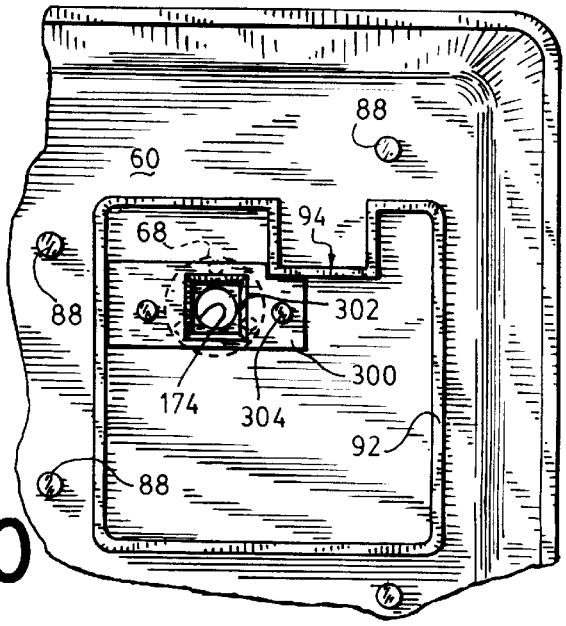
FIG. 20 is a fragmented plan view of the basin showing the location of the tank.

The housing 80 attached to the basin 60 is mounted by four feet 86 secured on mounting points 88, located into the bottom 64 of the basin 60, as seen on FIGS. 4 to 6. The housing 80 is properly positioned within internal grooves 90 at the bottom of the walls 91 of the housing 80 following an edge 92 on the bottom 64 of the basin 60 and having a perimeter taking on the exact shape of the walls 91 of the housing 80 (see FIG. 20), this edge 92 grooves 90 fitting establishes the watertight seal between the housing 80 and the basin 60. The walls 91 of the housing 80 being linked together by the ceiling 93 of the housing 80.

Figure 10:
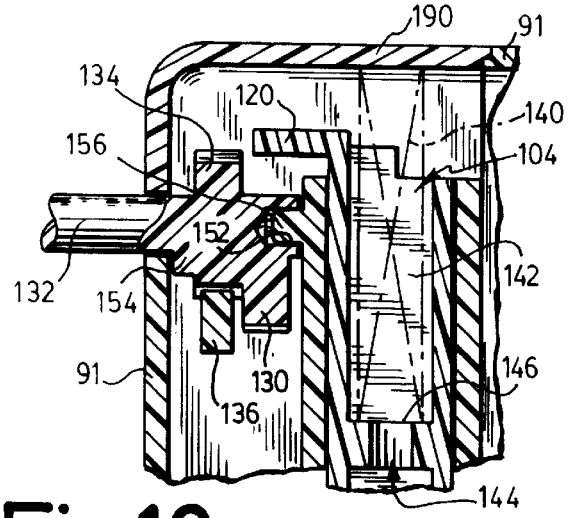
FIG. 10 is a sectional view according to line 10—10 of FIG. 7 showing the cam and the valve of the drain in a low position.
Figure 11:
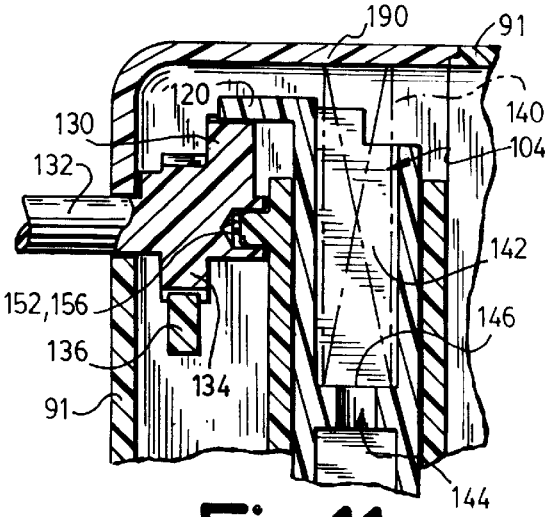
FIG. 11 is a similar view to FIG. 10 showing the cam and the valve of the drain in a high position.
Figure 12:
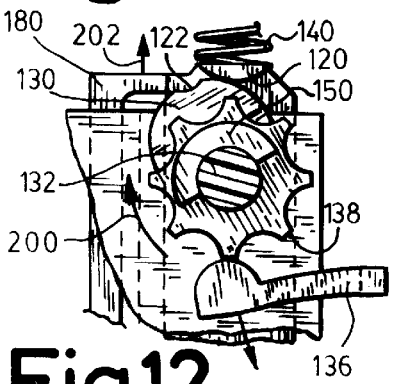
FIGS. 12 to 14 show an axial view of the motion mechanism of the valves driven by the cam reaching its high position.
Figure 13:
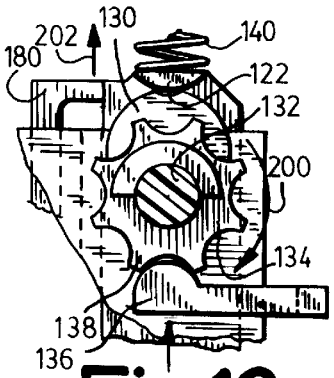
Figure 14:
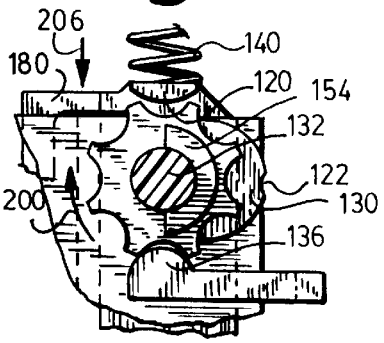
Figure 17:
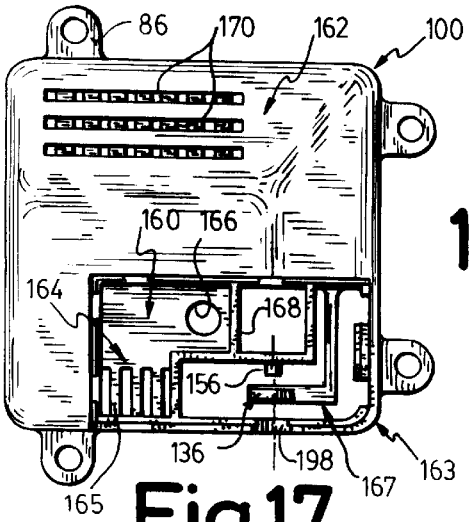
FIG. 17 is a plan view of the tank housing without its lid.
Figure 18:
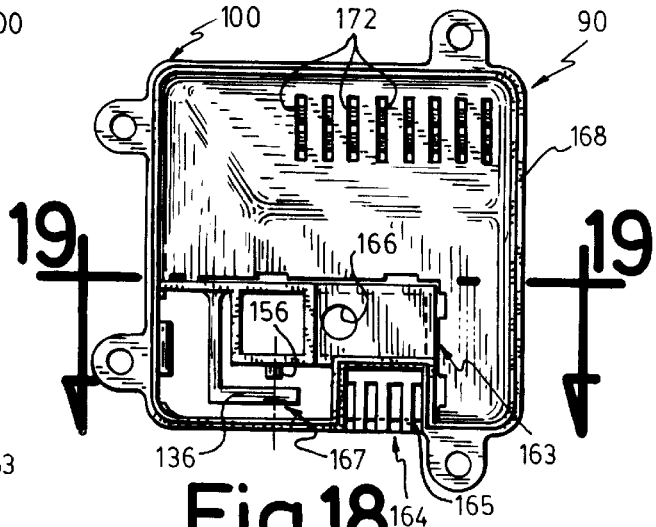
FIG. 18 is a bottom view of the tank housing without its lid.
Figure 19:
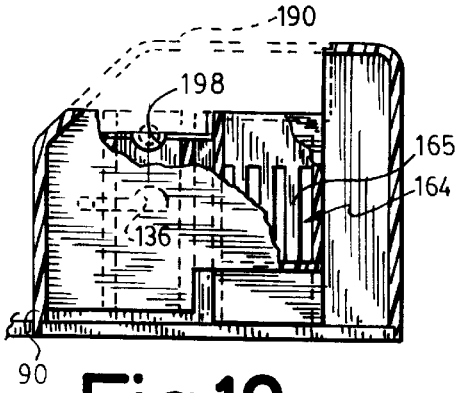
FIG. 19 is a sectional view according to line 19—19 of FIG. 18.
Figure 22:
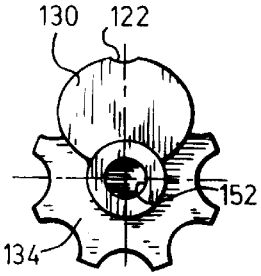
FIG. 22 is a right side view of the shaft, the jagged wheel and the cam of the preferred embodiment.
Figure 21:
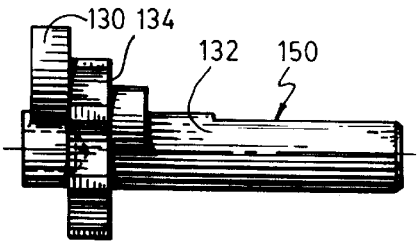
FIG. 21 is a front elevation view of the shaft, the jagged wheel and the cam of the preferred embodiment.
Figure 23:
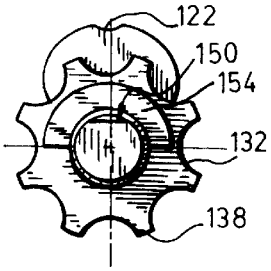
FIG. 23 is a left side view of the shaft, the jagged wheel and the cam of the preferred embodiment.

The housing 80, preferably consisting of a one piece structure 100 seen from the top and the bottom in FIGS. 17 and 18 respectively, contains the water circulation mechanism. The latter having a first valve 102 adjusting the opening of a hole 166 linking a cavity 106 to a tank 108 of the housing 80, a second valve 104 adjusting the closing of the drain 48, and a cam 130 used to activate the valves 102, 104 by lifting up a stop 120 linked to the two valves 102, 104. The rotation of this cam 130 is activated by a time switch system, preferably constituted of an activation mechanism itself made out of a rod 58 located on one extremity of the drum 52 (as seen on FIG. 5) that moves the cogs 84 of a cogwheel 82, the cam 130 and a holding system, preferably a spring 140. The cogwheel 82 is linked to the cam 130, both of them mounted onto a same shaft 132. The cam 130 is in a high position once every complete revolution of the cogwheel 82, thus inducing a cyclical movement to the circulation mechanism. The cam 130 turns simultaneously along with a small jagged wheel 134 that pushes onto the curved and flexible free end of an arm 136 used to stabilize and stop the shaft 132 after each little rotating movement, the arm acting similarly to a ratchet, as indicated on FIGS. 12 to 14. The rotation direction of the cam shaft 132 is shown by the arrow 200. When the cam 130 hits against the stop 120, the latter raises as shown by the arrow 202 driving with it the second valve 104 of the drain while compressing the spring 140 in between the second valve 104 and a lid 190 being a part of the ceiling 93 of the housing 80, as seen on FIG. 11. Simultaneously, the arm 136 passes to the next jagged outline 138 of the small jagged wheel 134. In the high position of the cam 130, a recess 122 at the tip of the cam 130 receives the stop 120, allowing for the latter to settle, thus providing a second stability element for this position in conjunction with the one obtained by the arm 136 located in between two jagged outlines 138 of the small jagged wheel 134. At the next rotational movement of the shaft 132, the cam 130 goes back down to release the spring 140 that pushes the second valve 104 towards the bottom and also makes the stop 120 go down, as shown by the arrow 206 in FIG. 14. The cam 130 together with its shaft 132 are preferably molded out into one piece as seen on FIGS. 21 to 23; the small jagged wheel 134 is also preferably an integral part of this piece. In order to allow the attachment of the cogwheel 82, the shaft 132 of the cam 130 has a flat 150 at its extremity as to form a key that gets into a truncated cylindrical hole of the cogwheel 82. A cylindrical recessed hole 152 axially dug into the extremity of the cam shaft 132 receives a cylindrical tenon 156 integrated to the one piece structure 100 of the housing 80 to allow for the attachment of the shaft 132. A half circular shoulder 154 adjacent to the small jagged wheel 134 of the cam 130 is used to maintain the cam shaft 132 into the housing 80 by leaning against the walls 91 of the housing 80, and to ease the assembly of part of the time switch system, as seen on FIGS. 10 and 11.

Figure 15:
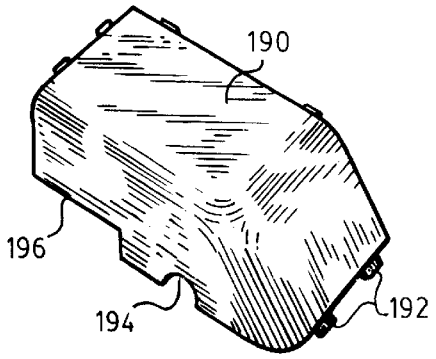
FIG. 15 is a top perspective view of the lid of the tank housing.
Figure 16:
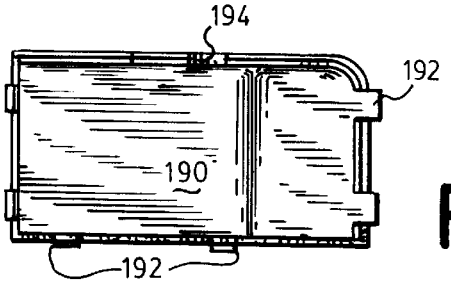
FIG. 16 is a bottom view of the lid of the tank housing.

The one piece structure 100 of the housing 80, seen on FIGS. 17 and 18, has a first section 162 used as a ceiling 93, a lid 190 and walls 91 of the tank 108 of the housing 80 that comprises an opening 171 in the shape of a trellis formed by three long parallel slits 170 on the top of the housing 80, seen on FIG. 17, and by eight short slits 172 perpendicular to the long ones 170 on the internal side of the housing 80 as shown on FIG. 18. The opening 171 allows for the filling of the tank 108 when there is an overflow. A second section 163 of the structure 100 comprises the cavity 160 having a hole 166 used as an opening for the first valve 102. The cavity 160 is raised with respect to the tank 108 in order to allow for the use of a vertical shifting valve 102, as seen on FIGS. 8 and 9. An opening 164 in the shape of a grid with in narrow strips 165 located under the water level allows for the filtration of the water of the basin 60 entering the cavity 106 of the housing 80 as shown by the arrow 210 on FIG. 5. The remaining section 167 of the structure 100 comprises the attachment of the cam shaft 132 at the cylindrical tenon 156, the arm 136 having an L shape, and a square slot guide 168 intended to receive the second valve 104 of the housing 80; the square guide 168 does not touch the bottom 64 of the basin 60, thus leaving a gap 169. The second section 163 of the structure 100 of the housing 80 is covered by a lid 190 attached to the top of the structure 100 with the help of attachment flanges 192 clipping to the ceiling 93 and to one of the walls 91 of the housing 80, as shown on FIGS. 15 and 16. Two semi-circular notches 194, 198 with a diameter of the shaft 132 are located on the edge of the lid 196 and inside one of the walls 91 of the structure 100 respectively, and allow for the shaft 132 to go through the housing 80.

Figure 8:
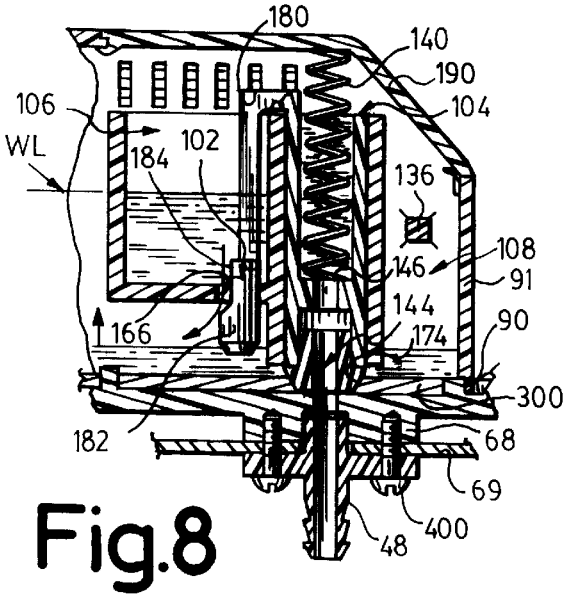
FIG. 8 is a sectional view according to line 8—8 of FIG. 6 showing the positions of the valves of the circulation mechanism during the filling of the tank.

The two valves 102, 104 of the circulation mechanism are linked together by a rigid bar 180 making the two valves 102, 104 to move simultaneously in the same direction when the stop 120 rigidly connected to the top of the second valve 104 moves. When the stop 120 is in a low position, the first valve 102 clears the hole 166 of the cavity 106 thus allowing for the water to fill in the tank 104. At the same time, the second valve 104 blocks the drain 48, as shown in FIG. 8. This blocking is obtained by the lower tip 176 of the second valve 104 made out of a resilient and flexible material providing a watertight seal. A plate 300 is attached via two mounting points 304 nearby an opening 174 of the drain 48 of the basin 60 in order to enhance the watertight seal. By the opening 174, the plate 300 has an opening 302 in the shape of a square window whose chambered perimeter takes the exact shape of the chambered square lower tip 176 of the second valve 104, allowing the latter to go against. The core 142 of the second valve 104 being a counterbore allowing for the spring 140 to lean on a stop 146. The lower section 144 of the second valve core 142 is perforated to allow for the water to be drained from the tank 108 through the top of the second valve 104 when there is an overflow of water in the basin 60 while the second valve 104 is locked in a low position. This system allows the use of a same drain 48 during the normal operation of the humidifier 30 and also when there is an overflow. The second valve 104 is in a longitudinal square shape with a section capable of sliding inside the square guide 168. When the stop 120 is moved in a high position under the action of the cam 130, the second valve 104 goes up not to close the opening 174 of the drain 48, thus emptying the tank 108 by allowing for the water to flow from the tank 108 into the drain 48 through the gap 169, as indicated by the arrows 220 on FIG. 9.

Figure 9:
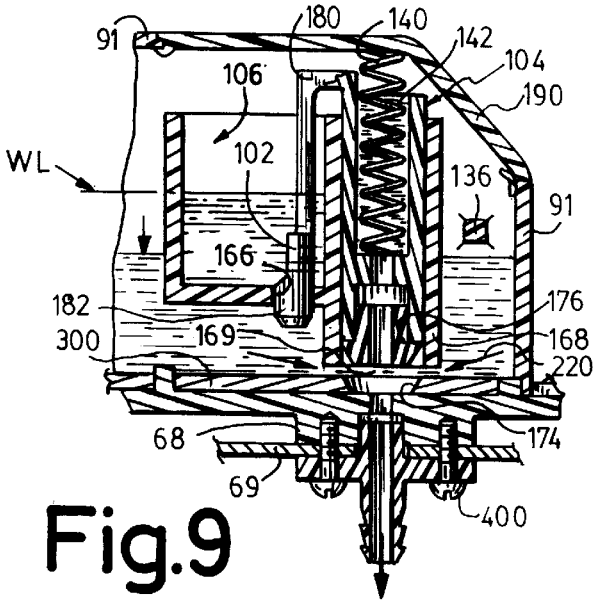
FIG. 9 is a similar view to FIG. 8 showing the positions of the valves of the circulation mechanism during the flow of water from the tank to the drain.

The drain 48 of the humidifier 30 is screwed to the external side of the bottom 69 of the humidifier 30 and to the collar 68 of the bottom 64 of the basin 60 surrounding the opening 174 of the drain 48 by two screws 400, as shown on FIGS. 8 and 9.

Although only a single embodiment of the present invention has been described and illustrated, the present invention is not limited to the features of this embodiment, but includes all variations and modifications within the scope of the claims.

We claim:

1. An air humidifier apparatus comprising:

a water entry;

a basin intended to contain the water coming from said entry;

a level regulator allowing to maintain a constant water level in said basin;

a rotating evaporator forcing evaporation of the water from said basin in the air;

a circulation means allowing, a cyclical circulation of the water in said basin;

an air intake and exit allowing air circulation through said evaporator;

a time switch means activating said circulation means and setting in motion said cyclical circulation of the water in said basin, said time switch means being activated by said evaporator;

a drain allowing said water to escape from said basin;

said circulation means being a tank linked to said basin by a first hole which opening is controlled by a first valve, and linked to said drain which closing is controlled by a second valve, said first hole and said drain never being simultaneously opened, said first and second valves being activated by said time switch means, said first hole allowing for water to get into said tank that is afterwards emptied when said drain is opened.

2. An air humidifier apparatus as defined in claim 1, wherein said time switch means comprises:

a first cam allowing for operation of said first valve;

a second cam allowing for operation of said second valve;

a first holding means forcing said first valve to follow said first cam a second holding means forcing said second valve to follow said second cam;

an activation mechanism activating said first and second cams.

3. An air humidifier apparatus as defined in claim 2, wherein said evaporator comprises:

a rotary drum having two circular extremities and being covered on its cylindrical peripheral surface with spongy material absorbing water and having a small part of said covered surface submerged into said water;

a drive mechanism providing a rotating motion to said drum.

4. An air humidifier apparatus as defined in claim 3, wherein said activation mechanism comprises a cogwheel linked to said cams through a shaft and activated by a plurality of rods located on one of the extremities of said drum of said evaporator.

5. An air humidifier apparatus as defined in claim 2, wherein said second holding means comprises:

a stop fixed to said second valve activated by said second cam via said activation mechanism;

a spring applying pressure on said second valve in order to push said stop into the axis direction of said second cam .

6. An air humidifier apparatus as defined in claim 2, wherein said first valve is linked to said second valve by a fixed rod, said fixed rod making said first and second cams as well as said first and second holding means being integrally connected as to form one piece.

7. An air humidifier apparatus as defined in claim 1, wherein said basin comprises a pipe means to discharge the overflow of water from said drain of said basin of said humidifier.

8. An air humidifier apparatus as defined in claim 1, further comprising an intermediate cavity linked to said basin by a filter allowing for filtration of the water before its entry in said tank by said first hole.

9. An air humidifier apparatus as defined in claim 4, further comprising a stabilization means of said activation mechanism.

10. An air humidifier apparatus as defined in claim 4, wherein said cogwheel comprises eight cogs, and said drum having only one said rod.

11. An air humidifier apparatus as defined in claim 9, wherein said stabilization means comprises:

a jagged wheel coaxially mounted on said shaft and having a number of outlines equal to the number of cogs of said cogwheel;

a ratchet allowing for the stabilization of said jagged wheel from any rotating movement of said shaft.

* * * * *